United States Patent [19]

Suzuki et al.

[11] Patent Number: 4,871,609

[45] Date of Patent: Oct. 3, 1989

[54] MULTICOLOR THERMOSENSITIVE IMAGE TRANSFER SHEET

[75] Inventors: Akira Suzuki, Mishima; Nobuo Mochizuki, Shizuoka; Kunichika Morohoshi, Numazu, all of Japan

[73] Assignee: Ricoh Company, Ltd., Tokyo, Japan

[21] Appl. No.: 94,876

[22] Filed: Sep. 10, 1987

[30] Foreign Application Priority Data

Sep. 10, 1986 [JP] Japan ..... 61-211511
Jul. 15, 1987 [JP] Japan ..... 62-174907

[51] Int. Cl.[4] ..... B41M 5/26

[52] U.S. Cl. ..... 428/195; 428/212; 428/319.9; 428/321.3; 428/413; 428/480; 428/484; 428/488.1; 428/500; 428/522; 428/524; 428/532; 428/913; 428/914

[58] Field of Search ..... 428/195, 409, 484, 488.1, 428/488.4, 913, 914, 207, 212, 319.9, 321.3, 413, 480, 500, 522, 524, 532

[56] References Cited

FOREIGN PATENT DOCUMENTS 189489 9/1984 Japan ..... 428/321.3
209196 11/1984 Japan ..... 428/914

OTHER PUBLICATIONS

Hackh's Chemical Dictionary, 4th Edition 1969, pp. 650,713.

*Primary Examiner*—Ellis P. Robinson
*Assistant Examiner*—P. R. Schwartz
*Attorney, Agent, or Firm*—Oblon, Spivak, McClelland, Maier & Neustadt

[57] ABSTRACT

A multicolor thermosensitive image transfer sheet comprising (i) a substrate and (ii) a plurality of thermofusible ink layers, formed thereon side by side, each thermofusible ink layer comprising a thermofusible ink component having a different color and a different surface tension from the colors and surface tensions of the ink components in the other thermofusible ink layers, and a multicolor thermosensitive image transfer recording method of obtaining multicolored images by transferring imagewise the thermofusible ink layers of the multicolor thermosensitive image transfer recording medium to a receiving sheet in the sequential order from the highest to the lowest, or from the lowest to the highest, critical surface tension of the thermofusible ink components are provided.

7 Claims, 1 Drawing Sheet

MULTICOLOR THERMOSENSITIVE IMAGE TRANSFER SHEET

BACKGROUND OF THE INVENTION

The present invention relates to a multicolor thermosensitive image transfer sheet which can provide a good multicolor image transfer with imagewise application of heat by a thermal head, laser, or the like, and to a recording method by using the multicolor thermosensitive image transfer sheet.

Conventionally, there is known a process of obtaining multicolored images by using (a) an image transfer medium for each color comprising a support and a thermosensitive image transfer ink layer formed thereon, comprising a coloring agent and a thermofusible material, or (b) an image transfer medium for each color comprising a support and a thermofusible image transfer ink layer formed thereon, comprising a fine porous structure made of a resin, containing therein a thermofusible material which is solid at room temperature, but can be melt when heated, and a binder agent, by (i) disposing the image transfer layers in a plurality of colors side by side, (ii) applying heat to the image transfer layers by a thermal head, a laser or the like, and (iii) transferring the image transfer layers imagewise successively to a receiving sheet in such a manner the colors may be built up.

In this case, if the same material is used for the thermofusible material for each color image transfer medium, the wetting characteristics are exactly the same, so that the image transfer ink layers, subsequently transferred to a receiving sheet, may well adhere to each other when transferred in a superimposing manner to a receiving sheet. Therefore, when the colors are built up, there is no problem in making each ink layer adhere to the ink layer which comes into contact therewith as it is applied. However, if there are many solid images, the amount of the image transfer layer components transferred from each color image transfer medium tends to become excessive. The result is that the hue of the topmost ink layer becomes dark, and a defect occurs in which the color balance of the image is degraded.

Recently it has been proposed to use an appropriate thermofusible material in each color image transfer medium, without using the same thermofusible material as mentioned above, from the aspect of the balance of the formulations of the ink layers, that is, from the aspect of the optimum match of the coloring agent and the thermofusible material in each color image transfer medium. The result is that such a defect occurs that the wetting characteristics of each color image transfer medium are different so that the mutual adhesion of the thermosensitive image transfer layers becomes poor, when superimposed on a receiving sheet.

A previous proposal by the inventors of the present invention is (i) a multicolor thermosensitive image transfer sheet comprising a plurality of thermofusible ink layers, each ink layer containing therein a thermofusible material having a different critical surface tension for each color, (ii) and a multicolor thermosensitive image transfer recording method by using the multicolor thermosensitive image transfer sheet in a sequence from a high critical surface tension of the thermofusible material to a low critical surface tension thereof in the thermofusible ink layers so that the colors are built up. However, if a different coloring agent is used in each thermofusible ink layer or a surfactant is employed in a different amount in each ink layer, the critical surface tension of each ink layer considerably differs when transferred to a receiving sheet. Therefore, the improvement of the above-mentioned color build up cannot be completely attained by merely adjusting the critical surface tension of the thermofusible material for use in each ink layer.

SUMMARY OF THE INVENTION

Accordingly, an object of the present invention is to provide, with due consideration to the drawbacks of such conventional multicolor thermosensitive image transfer media, a multicolor thermosensitive image transfer sheet comprising a substrate and a plurality of thermofusible ink layers formed thereon side by side, each thermofusible ink layer comprising a thermofusible ink component having a different color and a different surface tension from the colors and surface tensions of the ink components in the other ink layers.

Another object of the present invention is to provide a multicolor thermosensitive image transfer recording method of obtaining multicolored images by transferring imagewise the thermofusible ink layers of the above-mentioned multi-color thermosensitive image transfer sheet to a receiving sheet in the sequential order from the highest to the lowest, or from the lowest to the highest, critical surface tension of the thermofusible ink components.

DETAILED DESCRIPTION OF THE PREFERRED EMBODIMENTS

The structure of a multicolor thermosensitive image transfer sheet according to the present invention will now be explained with reference to the accompanying drawings.

Figure 1:
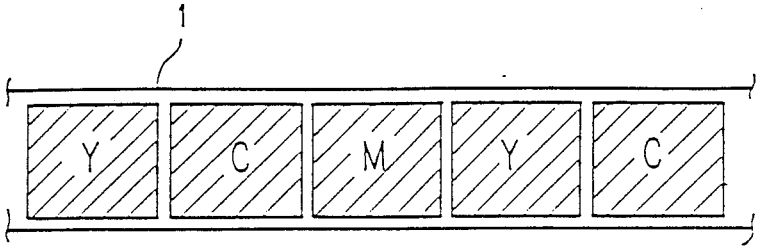
FIG. 1 is a plan view of a multicolor thermosensitive image transfer sheet according to the present invention.

FIG. 1 shows an example of a multicolor thermosensitive image transfer sheet according to the present invention. On a substrate 1, a plurality of thermofusible ink layers in the colors cyan (C), magenta (M) and yellow (Y) are arranged side by side in a row.

Figure 2:
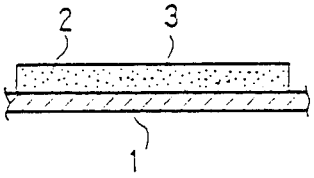
FIG. 2 is a partial sectional view of the multicolor thermosensitive image transfer sheet shown in FIG. 1.
Figure 3:
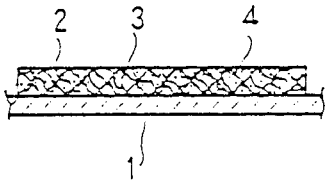
FIG. 3 is a cross-sectional view of another multicolor thermosensitive image transfer sheet according to the present invention.

The thermofusible ink layer may be formed on the substrate 1 by applying a thermofusible ink component comprising a coloring agent 2 and a thermofusible material 3 as shown in FIG. 2. Alternatively the thermofusible ink layer may be formed on the substrate 1 by containing the thermofusible ink component comprising the coloring agent 2 and the thermofusible material 3 held in a fine porous network structure 4, for instance, made of a resin, formed on the substrate 1 as shown in FIG. 3.

If in the above-mentioned thermofusible ink layers, the thermofusible ink component used for the cyan ink layer (C) is x, the thermofusible ink component used for the magenta ink layer (M) is y, and the thermofusible ink component used for the yellow ink layer (Y) is z, then the relationship among the respective critical surface tensions, $\gamma x$, $\gamma y$, and $\gamma z$ is $\gamma x \neq \gamma y \neq \gamma z$.

For the color build up, the thermofusible ink components are superimposed in the order of $\gamma x > \gamma y > \gamma z$. In order to prevent excessive transfer of the ink components in the course of the color build up, the superimposing order may be reversed in the order of $\gamma x < \gamma y < \gamma z$.

Here, the critical surface tension $\gamma$ is one of the physical property values of the thermofusible ink components, by which the "wetting property" thereof is indicated. The critical surface tension of such a solid material can be measured by (i) dropping a liquid standard test reagent for which the critical surface tension $\gamma$ is known on the solid material, (ii) measuring its contact angle with the solid material, repeating the measurement by using such liquid standard test reagents having different critical surface tensions, whereby the critical surface tension $\gamma$ of the solid material is obtained by the Zisman plot method using the thus obtained data. Basically, when there are thermofusible ink components x and y, if the mutual wetting property of the two components is high, the relationship between the respective critical surface tensions $\gamma x$ and $\gamma y$ is, $\gamma x = \gamma y$. Conversely, if $\gamma x$ does not equal $\gamma y$ (that is, $\gamma x \neq \gamma y$), the mutual wetting property is known to be poor.

The inventors of the present invention have investigated the relationship between the critical surface tension of the thermofusible ink component and the image quality. In the case of a liquid and a solid, even when $\gamma x \neq \gamma y$, there are cases of easy wetting. Depending upon the order of the magnitude of the critical surface tensions of the solid and the liquid, the wetting between the two changes. Specifically, supposing the ink component x is a solid and the ink component y is a liquid, and the liquid ink component y is superimposed on the solid ink component x, when $\gamma x > \gamma y$, the ink component y wets easily. However, when $\gamma x > \gamma y$, the ink component y wets with difficulty.

Accordingly, in the present invention, when the thermofusible ink component x is first transferred to a receiving sheet and the thermofusible ink component y is then transferred in the fused liquid state onto the thermofusible ink component x, when $\gamma x > \gamma y$, the ink component y is easily transferred onto the thermofusible ink component x, while when $\gamma x < \gamma y$, the ink component y cannot be easily transferred onto the thermofusible ink component x. This has been experimentally confirmed in image transfer recording tests.

Accordingly, in the present invention, the critical surface tension is made different for each color image transfer layer in order to facilitate the transfer of each color image transfer layer.

Further, according to the present invention, using the above-mentioned multicolor thermosensitive image transfer recording medium, a multicolor thermosensitive image transfer recording method is provided by successively superimposing the thermofusible ink component for each color in the order from high to low critical surface tension of the thermofusible ink component for each color.

Specifically, from the previously stated relationship between the relationship between $\gamma x$ and $\gamma y$, and the image transfer performance, in order to improve the efficiency of the color build up, the signal for indicating the order of transfer at the time of recording is set so as to carry out the transfer in the high order of $\gamma$, and conversely in the case where it is preferable that the efficiency of the color build up be decreased, for instance, in the case where there are many solid areas, the signal for indicating the order of transfer at the time of recording may be set so as to carry out the transfer in the low order of $\gamma$, whereby the best color balance is obtained.

The present invention is not restricted to the color build up of the three primary colors. For example, on considering the transfer onto a sheet of plain paper, the direct transfer of any of the primary colors onto the plain paper may be poor, which has an adverse effect on the overall color reproduction. In this case, there is known a method in which a three primary color sheet and a white color sheet coated with white wax are used, and the white wax of the white color sheet is first transferred to the plain paper. Even in this case according to the present invention, the white color sheet is fabricated so as to contain a thermofusible ink component having the highest critical surface tension $\gamma w$ as compared with the critical surface tensions of the thermofusible ink components for the three primary colors, a satisfactory color build up is obtained by transferring the thermofusible ink component of the first white color sheet, and then transferring the thermofusible ink components for the three primary colors in the order from the highest critical surface tension to the lowest critical surface tension.

Figure 4:
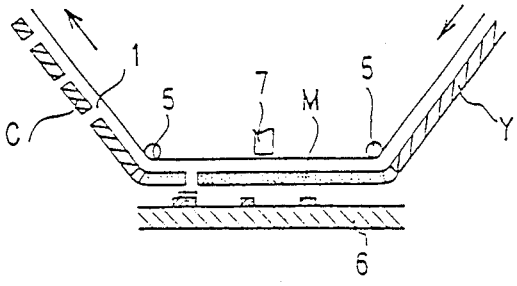
FIG. 4 is a schematic illustration in explanation of a recording method using a multicolor thermosensitive image transfer sheet according to the present invention.

Specifically as shown in FIG. 4, the thermofusible ink layers C, M and Y of a multicolor thermosensitive image transfer sheet stretched between a pair of rollers 5, 5 are positioned in the high order of the critical surface tensions of the thermofusible ink components thereof, in such a configuration as to be directed to a recording sheet 6. Heat is applied by means of a thermal head 7 from the side of the substrate 1, so that the thermofusible ink layers are successively transferred to the recording sheet 6. A portion of the ink layer C is transferred to the recording sheet 6, a portion of the ink layer M is then transferred onto one part of the transferred portion of the ink layer C, and then a portion of the ink layer Y is transferred onto one part of the transferred portions of any or both of the ink layers C and M, whereby a color image is obtained with good color reproducibility.

The critical surface tension of each of the ink components is mainly controlled by the critical surface tension of the thermofusible material contained in each ink component. However, the critical surface tension of each ink component will change according to the characteristics or the amount of the coloring agent and other additives contained in the ink component. Accordingly, if the amount of coloring agent and other additives throughout the ink component is small, the sequential order of the magnitudes of the critical surface tensions of the thermofusible ink components is equivalent to the sequential order of the magnitudes of the critical surface tension of the thermofusible materials.

The coloring agent, thermofusible material, softening agent, adhesives and substrate for use in the present invention can be materials which are conventionally employed in the field of this art. The fine porous structure can be made of a thermoplastic resin made of a homopolymer or copolymer of a monomer selected from the group consisting of vinyl chloride, vinyl acetate, vinylidene chloride, acrylic acid, methacrylic acid, acrylic acid ester, methacrylic acid ester, nitrocellulose, cellulose acetate, and cellulose butyrate, or a thermosetting resin such as phenolic resin, furan resin, formaldehyde resin, urea resin, melamine resin, alkyd resin, unsaturated polyester, and epoxy resin.

With reference to the following examples, the present invention will now be explained in detail. The features of this invention will become apparent in the course the following description of exemplary embodiments, which are given for illustration of the invention and not intended to limiting thereof.

EXAMPLE 1

The components for the thermofusible ink component in each of the following formulations were throughly dispersed, then the mixture was coated onto a commercially available polyester film having a thickness of 6 μm by the hot melt method, whereby three thermosensitive image transfer sheets for three primary colors, each having an ink layer about 3 μm thick, were obtained:

Formulation of Cyan Transfer Sheet

| | wt. % |
|---|---|
| Coloring agent: Heliogen Blue D-7030 (made by BASF) | 20 |
| Thermofusible material: Hi-Wax 4252E | 65 |
| Softening agent: oil | 10 |
| Additive: Liquid Paraffin | 5 |

The critical surface tension $\gamma$ of this thermofusible ink component was 36.7 dynes/cm.

Formulation of Magenta Transfer Sheet

| | wt. % |
|---|---|
| Coloring agent: First Carmine 1480 (made by Dainichi Seika Color and Chemicals Mfg. Co., Ltd.) | 20 |
| Thermofusible material: Hi-Wax 220MP | 65 |
| Softening agent: oil | 10 |
| Additive: Liquid Paraffin | 5 |

The critical surface tension $\gamma$ of this thermofusible ink component was 29.5 dynes/cm.

Formulation of Yellow Transfer Sheet

| | wt. % |
|---|---|
| Coloring agent: Sico Yellow D1250 (made by BASF) | 20 |
| Thermofusible material: Hi-Wax 110P | 65 |
| Softening agent: oil | 10 |
| Additive: Liquid Paraffin | 5 |

The critical surface tension $\gamma$ of this thermofusible ink component was 23.2 dynes/cm.

Using the above transfer sheets, color image transfer onto a sheet of synthetic paper in a design pattern was carried out by a test apparatus modified from a commercially available line-type color thermal transfer apparatus. The following results were obtained.

TABLE 1

| Color Transfer Order | Quality of Color Image | Evaluation of Image Transfer |
|---|---|---|
| C → M → Y | Good | Good |
| Y → M → C | Poor (Note 1) | No Good |
| M → Y → C | Poor (Note 2) | Poor |

(Note 1) The transfer of Y to the paper was good, but the transfer of M onto Y was poor, and the transfer of C onto M was worst.
(Note 2) The transfer of Y onto M was good, but C transfer was unsatisfactory.

EXAMPLE 2

Example 1 was repeated except that the formulations of the three primary color sheets were changed as follows, whereby three primary color sheets were prepared:

Formulation of Cyan Transfer Sheet

| | wt. % |
|---|---|
| Coloring agent: Heliogen Blue D7072D (made by BASF) | 20 |
| Thermofusible material: Montan BJ | 65 |
| Softening agent: oil | 10 |
| Additive: Liquid Paraffin | 5 |

The critical surface tension $\gamma$ of this thermofusible ink component was 31.5 dynes/cm.

Formulation of Magenta Transfer Sheet

| | wt. % |
|---|---|
| Coloring agent: Paliogen Red L-3910D (made by BASF) | 25 |
| Thermofusible material: Carnauba wax | 60 |
| Softening agent: oil | 10 |
| Additive: Liquid Paraffin | 5 |

The critical surface tension $\gamma$ of this thermofusible ink component was 24.8 dynes/cm.

Formulation of Yellow Transfer Sheet

| | wt. % |
|---|---|
| Coloring agent: Sico Yellow D1250 (made by BASF) | 25 |
| Thermofusible material: Paraffin HNP-3 (made by Nippon Seiro Co., Ltd.) | 60 |
| Softening agent: oil | 10 |
| Additive: Liquid Paraffin | 5 |

The critical surface tension $\gamma$ of this thermofusible ink component was 20.0 dynes/cm.

Using the above transfer sheets, color image transfer was carried out in the same manner as in Example 1. The results were as follow:

TABLE 2

| Color Transfer Order | Quality of Color Image | Evaluation of Image Transfer |
|---|---|---|
| C → M → Y | Good | Good |
| Y → M → C | Poor (Note 1) | Worst |
| M → Y → C | Poor (Note 2) | Poor |

(Note 1) The transfers of M onto Y and C onto Y were extremely poor.
(Note 2) C transfer was unsatisfactory.

EXAMPLE 3

The following components were throughly dispersed, then the mixture was coated onto a commercially available polyester film having a thickness of 6

μm by the hot melt method as in Example 1, whereby a white color thermosensitive image transfer sheet having a white ink layer about 3 μm thick, was prepared:

Formulation of White Transfer Sheet

| | wt. % |
|---|---|
| Coloring agent: Zinc oxide | 20 |
| Thermofusible material: Hi-Wax 4252E | 65 |
| Softening agent: oil | 10 |
| Additive: Liquid Paraffin | 5 |

The critical surface tension γ of this thermofusible ink component was 35.5 dynes/cm.

Using the above white transfer sheet, a white solid image was first formed on a sheet of commercially available plain paper (Xerox Paper No. 4024). Then, the following color image transfers were carried out in the same way for Example 2, using the same three primary color transfer sheets as those employed in Example 2, C→M→Y, Y→M→C, and C→Y→M. The result was that the best color image transfer was carried out with the C→M→Y sequence, and a good color image was obtained.

EXAMPLE 4

The components of the following formulations were each mixed separately in a mixed liquid of 100 parts by weight of methyl ethyl ketone and 130 parts by weight of toluene, and then thoroughly dispersed in a ball mill at 90° C. for about 48 hours, whereby the dispersions of the thermosensitive ink components for the three primary colors were prepared.

Next, 300 parts by weight of a 20% solution of vinyl chloride—vinyl acetate copolymer (consisting of 10 parts by weight of the copolymer, 20 parts by weight of toluene and 20 parts by weight of methyl ethyl ketone) were added separately to each of the above dispersions of the thermosensitive ink components, and dispersed in a ball mill for about one hour.

Each of the dispersions was applied to the top surface of a polyester film having a thickness of 6 μm, backed with a heat resistant layer of silicone resin, using a wire bar, and dried at 100° C. for 1 minute, whereby three thermosensitive image transfer sheets for the three primary colors, each having an ink layer about 5 μm thick, were obtained:

Formulation of Cyan Transfer Sheet

| | wt. % |
|---|---|
| Coloring agent: Neozapon Blue 807 (made by BASF) | 20 |
| Thermofusible material: Montan BJ | 40 |
| Softening agent: Modified lanolin oil | 20 |
| Dispersant: Sorbon S-80 | 5 |
| Additive: Liquid paraffin | 15 |

The critical surface tension γ of this thermofusible ink component was 29.9 dynes/cm.

Formulation of Magenta Transfer Sheet

| | wt. % |
|---|---|
| Coloring agent: Neozapon Red 365 (made by BASF) | 20 |
| Thermofusible material: Carnauba wax (made by Noda Wax Co., Ltd.) | 40 |

-continued

| | wt. % |
|---|---|
| Softening agent: Modified lanolin wax | 20 |
| Dispersant: Sorbon S-80 | 5 |
| Additive: Liquid paraffin | 15 |

The critical surface tension γ of this thermofusible ink component was 25.3 dynes/cm.

Formulation of Yellow Transfer Sheet

| | wt. % |
|---|---|
| Coloring agent: Neozapon Yellow 157 (made by BASF) | 20 |
| Thermofusible material: Paraffin HNP-3 | 40 |
| Softening agent: Modified lanolin oil | 10 |
| Dispersant: Sorbon S-80 | 5 |
| Additive: Liquid paraffin | 15 |

The critical surface tension γ of this thermofusible ink component was 20.3 dynes/cm.

Using the above transfer sheets, color image transfer onto a sheet of synthetic paper in a design pattern was carried out by a test apparatus modified from a commercially available line type color thermal transfer apparatus. The following results were obtained.

TABLE 3

| Color Transfer Order | Quality of Color Image | Evaluation of Image Transfer |
|---|---|---|
| C → M → Y | Good | Good |
| Y → M → C | Poor (Note 1) | No Good |
| M → Y → C | Poor (Note 2) | Poor |

(Note 1) The transfer of Y to the paper was good, but the transfer of M onto Y was poor, and the transfer of C onto M was worst.
(Note 2) The transfer of Y onto M was good, but C transfer was unsatisfactory.

EXAMPLE 5

With the following formulation, a white transfer sheet having a white ink layer was prepared in the same manner as in Example 4:

Formulation of White Transfer Sheet

| | wt. % |
|---|---|
| Coloring agent: Zinc oxide | 25 |
| Thermofusible material: Hi-Wax 4252E | 60 |
| Softening agent: oil | 10 |
| Additive: Liquid paraffin | 5 |

The critical surface tension γ of this thermofusible ink component was 35.5 dynes/cm.

Using the above white color thermosensitive image transfer sheet, a white solid image was first formed on a sheet of commercially available plain paper (Xerox Paper No. 4024). Then, the following color image transfers were carried out in the same way for Example 4, using the same three primary color transfer sheets employed in Example 4, C→M→Y, Y→M→C, and C→Y→M. The result was that the best color image transfer was obtained with the C→M→Y sequence, and a good color image was obtained.

EXAMPLE 6

The components of the following formulations were each mixed separately in a mixed liquid of 100 parts by weight of methyl ethyl ketone and 130 parts by weight of toluene, and then thoroughly dispersed in a ball mill at 90° C. for about 48 hours, whereby the dispersions of the thermosensitive ink components for the three primary colors were prepared.

Next, 300 parts by weight of a 20% solution of vinyl chloride—vinyl acetate copolymer (consisting of 10 parts by weight of the copolymer, 20 parts by weight of toluene and 20 parts by weight of methyl ethyl ketone) were added separately to each of the above dispersions of the thermosensitive ink components, and dispersed in a ball mill for about one hour.

Each of the dispersions was applied to the top surface of a polyester film having a thickness of 6 μm, backed with a heat resistant layer of silicone resin, using a wire bar, and dried at 100° C. for 1 minute, whereby three thermosensitive image transfer sheets for the three primary colors, each having an ink layer about 5 μm thick, were obtained:

Formulation of Cyan Transfer Sheet

| | wt. % |
|---|---|
| Coloring agent: Neozapon Blue 807 (made by BASF) | 20 |
| Thermofusible material: Carnauba Wax No. 1 (made by Noda Wax Co., Ltd.) | 40 |
| Softening agent: Modified lanolin oil | 20 |
| Dispersant: Sorbon S-80 | 5 |
| Additive: Liquid paraffin | 15 |

The critical surface tension $\gamma$ of this thermofusible ink component was 25.6 dynes/cm.

Formulation of Magenta Transfer Sheet

| | wt. % |
|---|---|
| Coloring agent: Neozapon Red 365 (made by BASF) | 20 |
| Thermofusible material: Carnauba Wax No. 1 (made by Noda Wax Co., Ltd.) | 40 |
| Softening agent: Modified lanolin wax | 20 |
| Dispersant: Sorbon S-80 | 5 |
| Additive: Liquid paraffin | 15 |

The critical surface tension $\gamma$ of this thermofusible ink component was 29.3 dynes/cm.

Formulation of Yellow Transfer Sheet

| | wt. % |
|---|---|
| Coloring agent: Neozapon Yellow 157 (made by BASF) | 20 |
| Thermofusible material: Carnauba Wax No. 1 (made by Noda Wax Co., Ltd.) | 40 |
| Softening agent: Modified lanolin oil | 20 |
| Dispersant: Sorbon S-80 | 5 |
| Additive: Liquid paraffin | 15 |

The critical surface tension $\gamma$ of this thermofusible ink component was 24.7 dynes/cm.

Using the above transfer sheets, the color image transfer onto a sheet of synthetic paper in a design pattern was carried out by a test apparatus modified from a commercially available line-type color thermal transfer apparatus. The following results were obtained.

TABLE 4

| Color Transfer Order | Quality of Color Image | Evaluation of Image Transfer |
|---|---|---|
| M → C → Y | Good | Good |
| C → M → Y | Poor (Note 1) | No Good |
| M → Y → C | Poor (Note 2) | Poor |

(Note 1) The transfer of C to the paper was good, but the transfer of M onto Y was unsatisfactory.
(Note 2) The transfer of Y onto M was good, but C transfer was unsatisfactory.

EXAMPLE 7

With the following formulation, a white transfer sheet was prepared in the same manner as in Example 4:

Formulation of White Transfer Sheet

| | wt. % |
|---|---|
| Coloring agent: Calcium carbonate | 25 |
| Thermofusible material: Hi-Wax 4252E | 60 |
| Softening agent: oil | 10 |
| Additive: Liquid paraffin | 5 |

The critical surface tension $\gamma$ of this thermofusible ink component was 36.5 dynes/cm.

Using the above white color thermosensitive image transfer sheet, a white solid image was first formed on a sheet of plain paper. Then, the following color image transfers were carried out in the same way for Example 6, using the same three primary color transfer sheets employed in Example 6, C→M→Y, Y→M→C, M→Y→C, and C→Y→M. The result was that the best color image transfer was obtained with the M→C→Y sequence, and a good color image was obtained.

What is claimed is:

1. A multicolor thermosensitive image transfer sheet, comprising:
   (i) a substrate and
   (ii) at least three thermosensitive ink layers each having a different color and each having a different critical surface tension, which layers are formed side-by-side in an increasing or decreasing order with respect to critical surface tension, each of said thermosensitive ink layers comprising a thermofusible ink component having a different color and a different critical surface tension from the color and surface tensions of the ink components in the other thermofusible ink layers.

2. The multicolor thermosensitive image transfer sheet as claimed in claim 1, wherein the different colored thermosensitive ink layers are such that one layer is a cyan thermosensitive ink layer, another layer is a magenta thermosensitive ink layer and another is a yellow thermosensitive ink layer.

3. The multicolor thermosensitive image transfer sheet as claimed in claim 2, wherein the plurality of thermosensitive ink layers further comprises a black thermosensitive ink layer.

4. The multicolor thermosensitive image transfer sheet as claimed in claim 1, wherein said thermofusible ink component comprises a coloring agent and a thermofusible material.

5. The multicolor thermosensitive image transfer sheet as claimed in claim 1, wherein said thermofusible ink layer comprises a fine porous network structure and said thermofusible ink component held in said fine porous network.

6. The multicolor thermosensitive image transfer sheet as claimed in claim 5, wherein said thermofusible ink component comprises a coloring agent and a thermofusible material.

7. The multicolored thermosensitive image transfer sheet as claimed in claim 5, wherein in the fine porous network structure of each layer is formed of a thermoplastic homopolymer or copolymer prepared from a monomer selected from the group consisting of vinylchloride, vinylacetate, vinyldiene chloride, acrylic acid, methacrylic acid, acrylic acid ester, methacrylic acid ester, nitrocellulose, cellulose acetate and cellulose butyrate, or a thermosetting resin selected from the group consisting of phenolic resin, furan resin, formaldehyde resin, urea resin, melamine resin, alkyd resin, an unsaturated polyester and an epoxy resin.

* * * * *